US009489880B2

(12) United States Patent
Lin

(10) Patent No.: US 9,489,880 B2
(45) Date of Patent: Nov. 8, 2016

(54) DISPLAY SYSTEM AND DRIVING METHOD

(71) Applicant: HIMAX TECHNOLOGIES LIMITED, Tainan (TW)

(72) Inventor: Chih-Feng Lin, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 155 days.

(21) Appl. No.: 14/473,551

(22) Filed: Aug. 29, 2014

(65) Prior Publication Data

US 2016/0063908 A1 Mar. 3, 2016

(51) Int. Cl.
*G09G 3/20* (2006.01)
*G09G 3/36* (2006.01)

(52) U.S. Cl.
CPC ..... *G09G 3/2003* (2013.01); *G09G 3/3607* (2013.01); *G09G 2300/0452* (2013.01); *G09G 2310/027* (2013.01); *G09G 2320/0666* (2013.01)

(58) Field of Classification Search
None
See application file for complete search history.

(56) References Cited

U.S. PATENT DOCUMENTS

| | | | | |
|---|---|---|---|---|
| 7,184,066 | B2 | 2/2007 | Elliot et al. | |
| 7,505,053 | B2 | 3/2009 | Brown Elliott et al. | |
| 8,786,645 | B2 | 7/2014 | Gu | |
| 2005/0225575 | A1* | 10/2005 | Brown Elliott ... | G02F 1/133514 345/694 |
| 2012/0139965 | A1* | 6/2012 | Yang ..... | G09G 3/3225 345/690 |

FOREIGN PATENT DOCUMENTS

| | | | |
|---|---|---|---|
| CN | 102044232 | A | 5/2011 |
| TW | 201434023 | A | 9/2014 |

* cited by examiner

*Primary Examiner* — Seokyun Moon
(74) *Attorney, Agent, or Firm* — Locke Lord LLP; Tim Tingkang Xia, Esq.

(57) ABSTRACT

A method for driving a display device is disclosed. Each pixel of the display device includes a first sub-pixel and a second sub-pixel. The method includes: driving the first sub-pixel of a first pixel disposed in a first column and in a first row to display a first color; driving the second sub-pixel of the first pixel to display a second color; driving the first sub-pixel of a second pixel disposed in the first column and in a second row or a third row to display a third color; driving the second sub-pixel of the second pixel to display the first color; and determining a pixel value of the first sub-pixel of the first pixel according to a predetermined region, the pixels adjacent to the first pixel, and a video signal.

12 Claims, 7 Drawing Sheets

DISPLAY SYSTEM AND DRIVING METHOD

BACKGROUND

1. Technical Field

The present disclosure relates to a display system. More particularly, the present disclosure relates to an arrangement for sub-pixels of the display system.

2. Description of Related Art

Display devices are commonly used in a variety of electronic products. Pixels of a display panel are divided into three sub-pixels, and thus each of the sub-pixels can be driven individually.

However, as the development of the resolution of the display panel, the size of the sub-pixels is limited. As a result, an aperture ratio is reduced, and a difficulty of manufacture is increased.

SUMMARY

One aspect of the present disclosure is to provide a display system. The display system includes pixels arranged in rows and columns and a driving device. Each of the pixels includes a first sub-pixel and a second sub-pixel arranged along a horizontal direction. The pixels include a first pixel disposed in a first column of pixels and in a first row of pixels and a second pixel disposed in the first column of pixels and in one of a second row of pixels or a third row of pixels. The first sub-pixel of the first pixel is configured to display a first color, and the second sub-pixel of the first pixel is configured to display a second color. The second pixel disposed in the first column of pixels and in one of a second row of pixels and a third row of pixels. The first sub-pixel of the second pixel is configured to display a third color, and the second sub-pixel of the second pixel is configured to display the first color. The driving device is configured to determine a pixel value of the first sub-pixel of the first pixel according to a predetermined region, the pixels adjacent to the first pixel, and a video signal.

Another aspect of the present disclosure is to provide a method for driving a display device, in which the display device includes pixels arranged in rows and columns, each of the pixels having a first sub-pixel and a second sub-pixel arranged in a horizontal direction. The method includes: driving the first sub-pixel of a first pixel of the pixels to display a first color, in which the first pixel is disposed in a first column of pixels and in a first row of pixels; driving the second sub-pixel of the first pixel to display a second color; driving the first sub-pixel of a second pixel to display a third color, in which the second pixel is disposed in the first column of pixels and in a second row of pixels or a third row of pixels; driving the second sub-pixel of the second pixel to display the first color; and determining a pixel value of the first sub-pixel of the first pixel according to a predetermined region, the pixels adjacent to the first pixel, and a video signal.

Yet another aspect of the present disclosure is to provide a non-transitory computer readable storage medium for executing a driving method to drive a display device, in which the display device includes pixels arranged in rows and columns, each of the pixels having a first sub-pixel and a second sub-pixel arranged in a horizontal direction. The method includes: driving the first sub-pixel of a first pixel of the pixels to display a first color, in which the first pixel is disposed in a first column of pixels and in a first row of pixels; driving the second sub-pixel of the first pixel to display a second color; driving the first sub-pixel of a second pixel to display a third color, in which the second pixel is disposed in the first column of pixels and in a second row of pixels or a third row of pixels; driving the second sub-pixel of the second pixel to display the first color; and determining a pixel value of the first sub-pixel of the first pixel according to a predetermined region, the pixels adjacent to the first pixel, and a video signal.

In summary, the display system and the method for driving a display device of the present disclosure are able to improve the aperture ratio of the display panel and remain the display quality as well. Thus, manufacture difficulty and manufacture cost of the display panel are also reduced.

It is to be understood that both the foregoing general description and the following detailed description are by examples, and are intended to provide further explanation of the invention as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
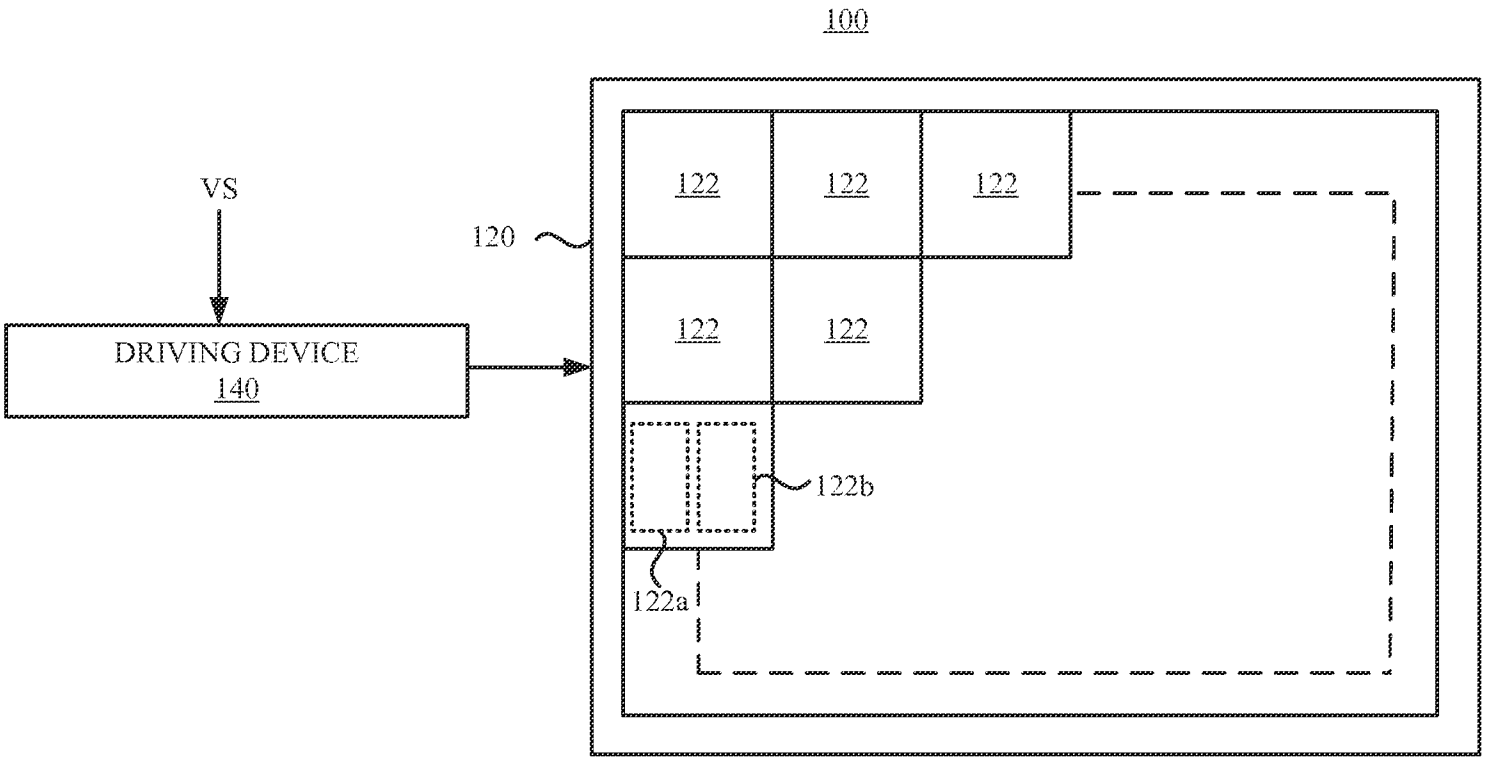
FIG. 1 is a schematic diagram of a display system, in accordance with various embodiments of the present disclosure.

Reference will now be made in detail to the present embodiments of the invention, examples of which are illustrated in the accompanying drawings. Wherever possible, the same reference numbers are used in the drawings and the description to refer to the same or like parts.

Although the terms "first," "second," etc., may be used herein to describe various elements, these elements should not be limited by these terms. These terms are used to distinguish one element from another.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

In this document, the term "coupled" may also be termed as "electrically coupled", and the term "connected" may be termed as "electrically connected". "Coupled" and "connected" may also be used to indicate that two or more elements cooperate or interact with each other.

Reference is made to FIG. 1. FIG. 1 is a schematic diagram of a display system, in accordance with various embodiments of the present disclosure. As shown in FIG. 1, the display system 100 includes a display panel 120 and a driving device 140.

The display panel 120 includes pixels 122. The pixels 122 are arranged in row and columns. Each of the pixels 122 includes a sub-pixel 122*a* and a sub-pixel 122*b*, and the sub-pixel 122*a* and the sub-pixel 122*b* are arranged along a horizontal direction. For each of the pixels 122, the first sub-pixel 122*a* and the sub-pixel 122*b* are configured to display two different colors, e.g., two colors of red, green, and blue.

The driving device 140 is coupled to the display panel 120, and is configured to drive the display panel 120. In some embodiments, the driving device 140 is configured to determine pixel values of the sub-pixel 122*a* and the sub-pixel 122*b* of each of the pixels 122 in accordance with a video signal VS.

Figure 2:
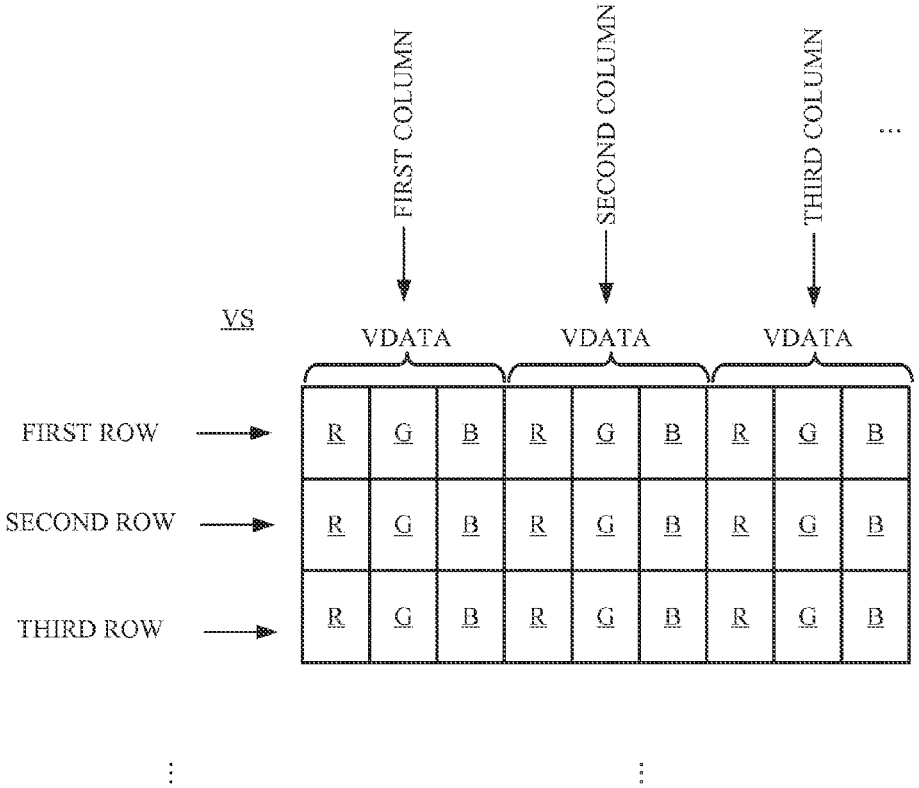
FIG. 2 is a schematic diagram illustrating arrangements of data values of the video signal shown in FIG. 1, in accordance with various embodiments of the present disclosure.

Reference is made to FIG. 2. FIG. 2 is a schematic diagram illustrating arrangements of data values of the video signal shown in FIG. 1, in accordance with various embodiments of the present disclosure.

As shown in FIG. 2, the video signal VS is provided to drive the each of the rows of the pixels 122, in which the video signal VS includes image data VDATA. Each of the image data VDATA includes data values R, G, and B. The data value R is indicative of a pixel value for displaying red. The data value G is indicative of a pixel value for displaying green. The data value B is indicative of a pixel value for displaying blue. In some approaches, each of the image data VDATA is able to drive the pixel having three sub-pixels.

Figure 3A:
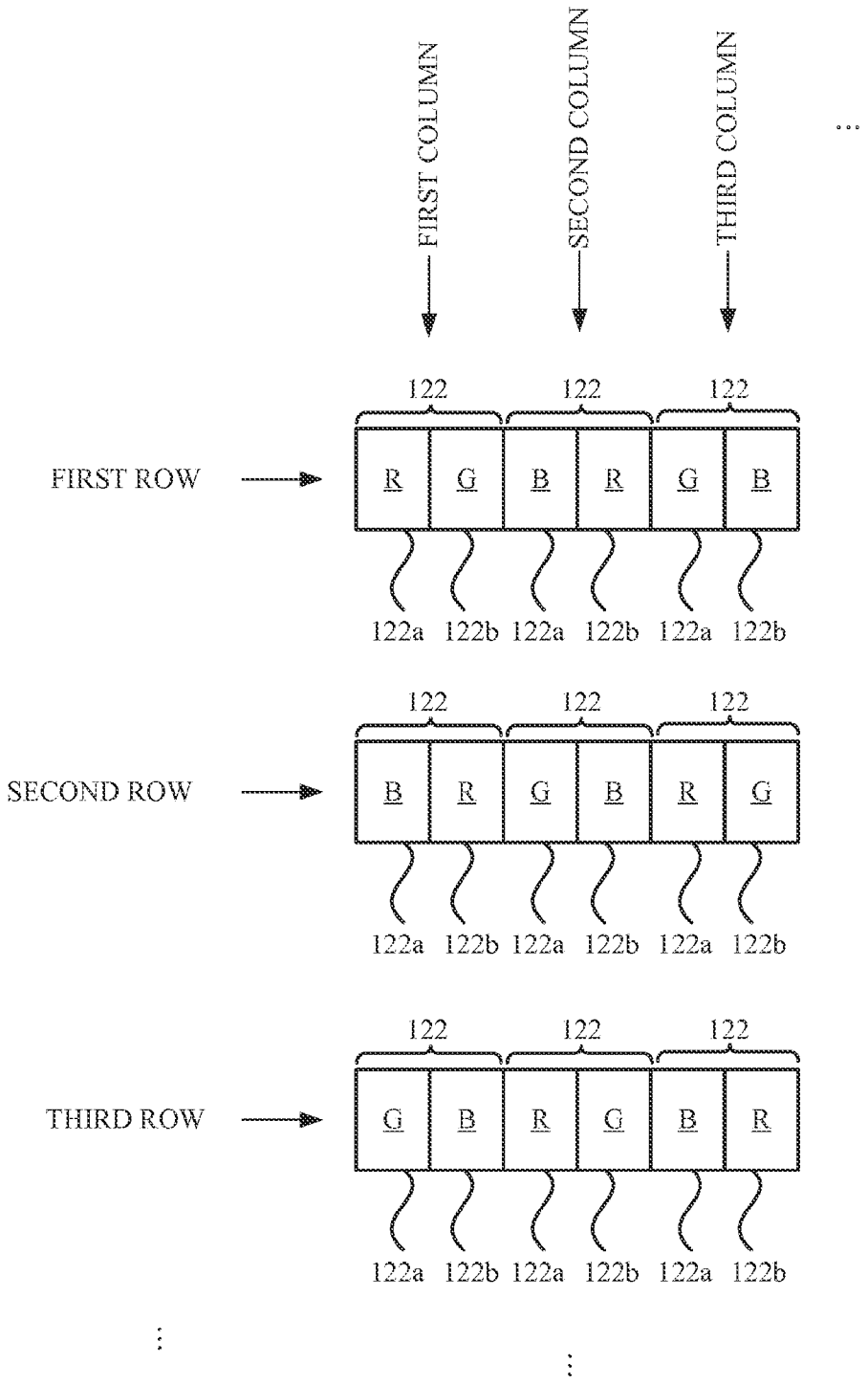
FIG. 3A is a schematic diagram illustrating arrangements of the pixels in the display system shown in FIG. 1, in accordance with various embodiments of the present disclosure.
Figure 3B:
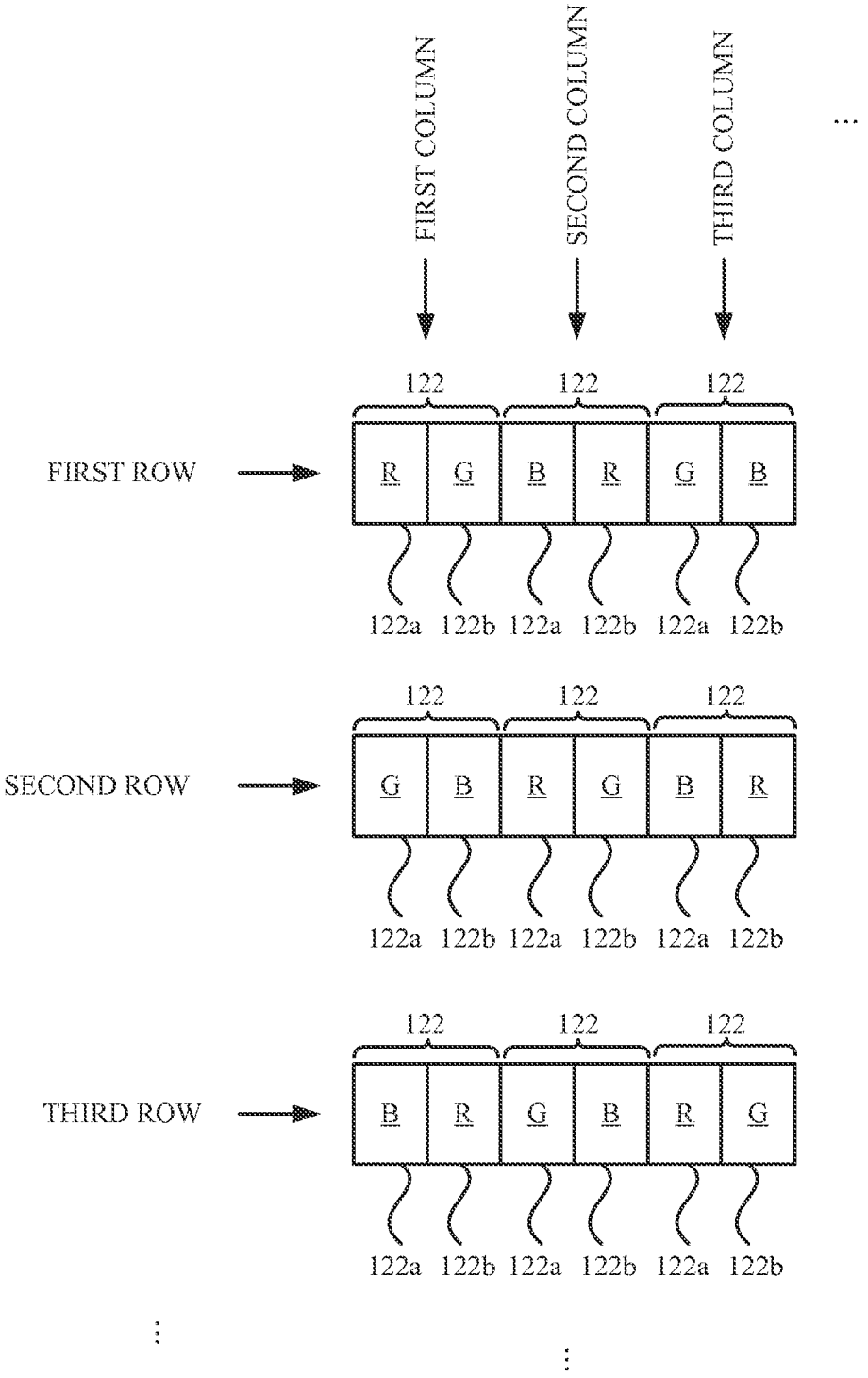
FIG. 3B is a schematic diagram illustrating another arrangements of the pixels in the display system shown in FIG. 1, in accordance with various embodiments of the present disclosure.

Reference is made to FIG. 3A and FIG. 3B. FIG. 3A is a schematic diagram illustrating arrangements of the pixels in the display system shown in FIG. 1, in accordance with various embodiments of the present disclosure. FIG. 3B is a schematic diagram illustrating another arrangements of the pixels in the display system shown in FIG. 1, in accordance with various embodiments of the present disclosure.

As shown in 3A, as the pixels 122 are configured to include two sub-pixels, i.e., the sub-pixels 122*a* and 122*b*, each of the pixels 122 is configured to display two different colors.

For illustration, as shown in FIG. 3A, the sub-pixel 122*a* of the pixel 122 arranged in a first row and a first column is configured to display red, and the sub-pixel 122*b* of the pixel 122 arranged in a first row and a first column is configured to display green. The sub-pixel 122*a* of the pixel 122 arranged in a second row and the first column is configured to display blue, and the sub-pixel 122*b* of the pixel 122 arranged in the second row and the first column is configured to display red. The sub-pixel 122*a* of the pixel 122 arranged in a third row and the first column is configured to display green, and the sub-pixel 122*b* of the pixel 122 arranged in the third row and the first column is configured to display blue. In other words, in this embodiment, the pixel values for the sub-pixels 122*a* and 122*b* in the first row are sequentially arranged in R, G, B, R, G, B along the horizontal direction of the display panel 120, the pixel values for the sub-pixels 122*a* and 122*b* in the second row are sequentially arranged in B, R, G, B, R, G along the horizontal direction of the display panel 120, and the pixel values for the sub-pixels 122*a* and 122*b* in the third row are sequentially arranged in G, B, R, G, B, R along the horizontal direction of the display panel 120. This arrangement for the first row, the second row and the third row is sequentially repeated along the vertical direction of the display panel 120.

Alternatively, in some other embodiments, as shown in FIG. 3B, the sub-pixel 122*a* of the pixel 122 arranged in the first row and the first column is configured to display red, and the sub-pixel 122*b* of the pixel 122 arranged in the first row and the first column is configured to display green. The sub-pixel 122*a* of the pixel 122 arranged in the second row and the first column is configured to display green, and the sub-pixel 122*b* of the pixel 122 arranged in the second row and the first column is configured to display blue. The sub-pixel 122*a* of the pixel 122 arranged in the third row and the first column is configured to display blue, and the sub-pixel 122*b* of the pixel 122 arranged in the third row and the first column is configured to display red. In other words, in this embodiment, the pixel values for the sub-pixels 122*a* and 122*b* in the first row are sequentially arranged in R, G, B, R, G, B along the horizontal direction of the display panel 120, the pixel values for the sub-pixels 122*a* and 122*b* in the second row are sequentially arranged in G, B, R, G, B, R along the horizontal direction of the display panel 120, and the pixel values for the sub-pixels 122*a* and 122*b* in the third row are sequentially arranged in B, R, G, B, R, G along the horizontal direction of the display panel 120. Similarly, this arrangement for the first row, the second row and the third row is sequentially repeated along the vertical direction of the display panel 120.

Thus, the driving device 140 is configured to determine the pixel values of the corresponding color for the sub-pixels 122*a* and 122*b* according to the video signal VS. With such configuration, the size of the sub-pixels 122*a* and 122*b* is increased, and thus the difficulty of manufacture can be reduced. Further, compared with the pixel having three sub-pixels in some approaches, an aperture ratio of the display panel 120 can be improved. The detailed operations of determining the pixel values are described in the following paragraphs with references to FIG. 4 and FIG. 5, respectively.

Figure 4:
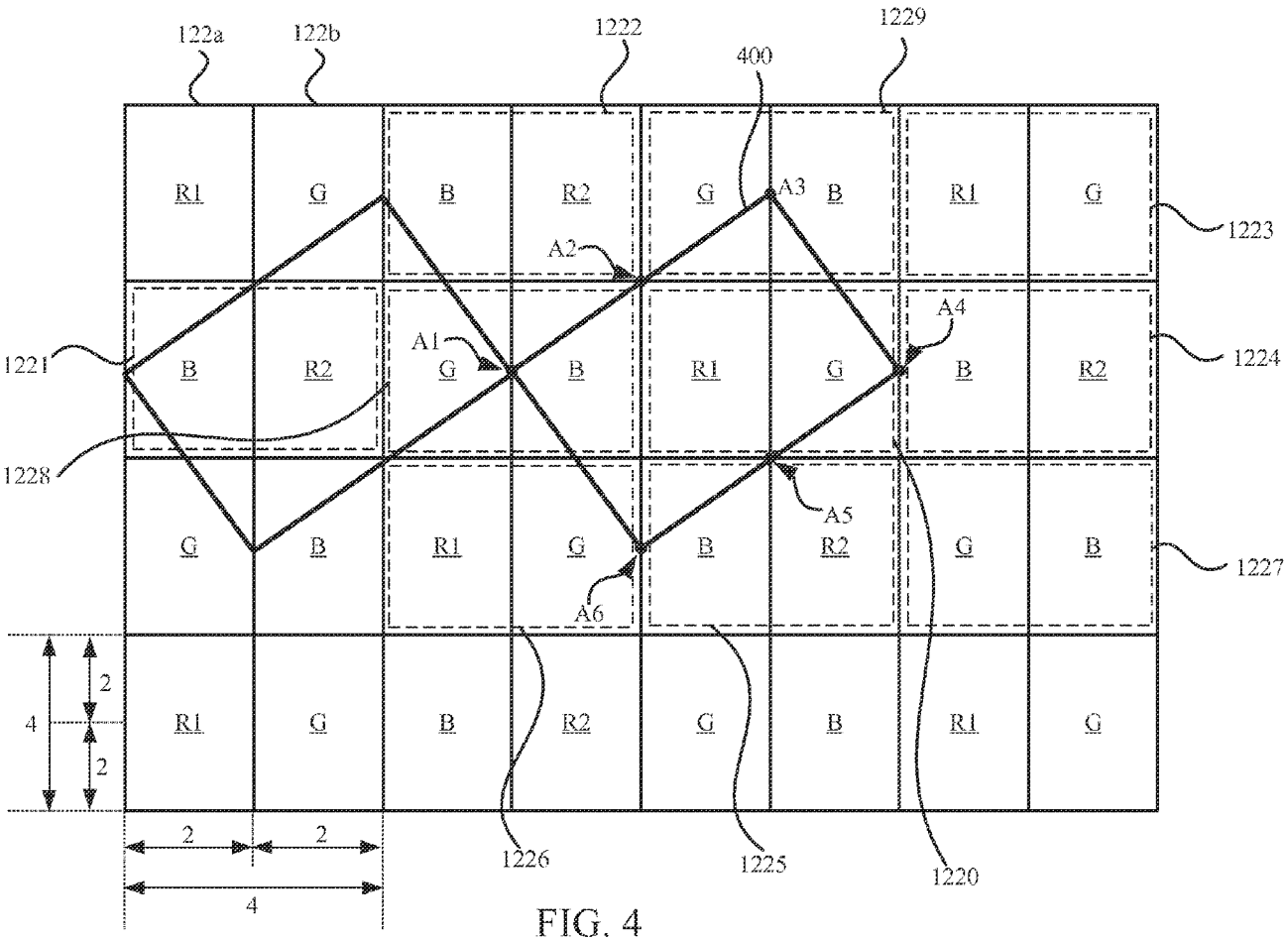
FIG. 4 is a schematic diagram illustrating operations of determining pixel values, in accordance with various embodiments of the present disclosure.

Reference is made to FIG. 4. FIG. 4 is a schematic diagram illustrating operations of determining pixel values, in accordance with various embodiments of the present disclosure.

In some embodiments, the driving device 140 is configured to determine the pixel value of the sub-pixel 122*a* or 122*b* of a corresponding pixel 1220 according to a predetermined region, areas of the predetermine region covered by the pixel 1220 and the pixels 122 around the corresponding pixel 1220, and data values of the color displayed by the sub-pixel 122*a* or 122*b*, corresponding to the pixel 1220 and the pixels 122 around the corresponding pixel 1220, of the video signal VS.

As shown in FIG. 4, the predetermined region 400 has a shape of a parallelogram. Taking the sub-pixel 122*a* of the pixel 1220 as an example, the sub-pixel 122*a* is configured to display red, and the pixel value of the sub-pixel 122*a* is called as R1 hereinafter. The predetermined region 400 is set by connecting points A1-A6. The point A1 is set to be located at half of a distance between the barycenter position of the sub-pixel 122*a* of the pixel 1220 and the barycenter position of the sub-pixel 122*b*, configured to display red, of the pixel 1221. The point A2 is set to be located at half of a distance between the barycenter position of the sub-pixel 122*a* of the pixel 1220 and the barycenter position of the sub-pixel 122*b*, configured to display red, of the pixel 1222. The point A3 is set to be located at half of a distance between the barycenter position of the sub-pixel 122*b* of the pixel 1222 and the barycenter position of the sub-pixel 122*a*, configured to display red, of the pixel 1223. The point A4 is set to be located at half of a distance between the barycenter position of the sub-pixel 122*a* of the pixel 1220 and the barycenter position of the sub-pixel 122*b*, configured to display red, of the pixel 1224. The point A5 is set to be located at half of a distance between the barycenter position of the sub-pixel 122*a* of the pixel 1220 and the barycenter position of the sub-pixel 122*b*, configured to display red, of the pixel 1225. The point A6 is set to be located at half of a distance between the barycenter position of the sub-pixel 122*a* of the pixel 1226 and the barycenter position of the sub-pixel 122*b*, configured to display red, of the pixel 1225.

In various embodiments, as shown in FIG. 4, sides of each of the pixels 122 are configured to be 4 units of length. In other words, the length of each of the sub-pixel 122*a* and the sub-pixel 122*b* is 2 units of length, and the height of each of the sub-pixel 122*a* and the sub-pixel 122*b* is 4 units of length. As a result, each one of the sub-pixel 122*a* and the sub-pixel 122*b* has an aspect ratio of about 1:2.

The driving device 140 is able to determine the pixel value R1 for the sub-pixel 122*a* of the pixel 1220 by calculating areas of the predetermined region 400 covered by the pixel 1220 and the pixels around the pixel 1220, i.e., the pixels 1222-1229. For illustration, the areas of the predetermined region 400 covered by the pixel 1222, the pixel 1223, the pixel 1224, and the pixel 1227 are zero. The area of the predetermined region 400 covered by the pixel 1228 is determined as follows: 8−1−2=5, in which 8 is the area of the sub-pixel 122*b* of the pixel 1228, and 1 and 2 are areas of the two triangular regions, which are not covered by the predetermined region 400, of the sub-pixel 122*b* of the pixel 1228. The area of the predetermined region 400 covered by the pixel 1226 is determined as follows: (½) *1*2=1 (determined by using the formula of the triangular area). Therefore, with the similar calculations, the area of the predetermined region 400 covered by the pixel 1229 is determined as 3, the area of the predetermined region 400 covered by the pixel 1220 is determined as 13, and the area of the predetermined region 400 covered by the pixel 1225 is determined as 2.

Thus, the driving device 140 is able to determine the pixel value R1 by using the areas determined above and the data values of red, corresponding to pixel 1220 and the pixels 1222-1229, of the video signal VS. Explained in a different way, the driving device 140 is configured to determine the pixel value R1 by calculating weighted coefficients related to the sub-pixel 122*a* of the pixel 1220 from the areas of the predetermined region 400 covered by the pixel 1220 and the pixels 1222-1229. With such configuration, the sub-pixel 122*a* of the pixel 1220 is able to display red as similar as the data values R of the video signal VS.

For illustration, after the areas of the predetermined region 400 covered by the pixels 1220 and 1222-1229 are obtained, the driving device 140 finds that the weighted coefficients WR1 related to the sub-pixel 122*a* of the pixel 1220 can be determined as an equation (1) below, in which 24 is the area of the predetermined region 400. Thus, the driving device 140 can generate the pixel value R1 by using the weighted coefficients WR1 and the data values R, corresponding to the pixel 1220 and 1222-1229, of the video signal VS.

$$WR1 = \begin{bmatrix} 0 & 3 & 0 \\ 5 & 13 & 0 \\ 1 & 2 & 0 \end{bmatrix} \Big/ 24 \tag{1}$$

Similarly, the driving device 140 is able to determine the pixel value of the sub-pixel 122*b* (called as R2 hereinafter) of the pixel 1222 with similar operations, and the repetitious descriptions are not given here. The driving device 140 finds that the weighted coefficients WR2 related to the sub-pixel 122*b* of the pixel 1222 can be determined as an equation (2) below, and the driving device 140 thus generates the pixel value R2 by using the weighted coefficients WR2 and the data values R, corresponding to the pixels adjacent to the pixel 1222, of the video signal VS.

$$WR2 = \begin{bmatrix} 0 & 2 & 1 \\ 0 & 13 & 5 \\ 0 & 3 & 0 \end{bmatrix} \Big/ 24 \tag{2}$$

In some ways, the weighted coefficients WR1 are able to be the weighted coefficients for the sub-pixel 122*b* of each of the pixels 122, and the weighted coefficients WR2 are able to be the weighted coefficients for the sub-pixel 122*a* of each of the pixels 122. In other words, in some embodiments, the driving device 140 is able to calculate the weighted coefficients WR1 and the weighted coefficients WR2 for once, and thus the driving device 140 is able to determine all of the pixel values for each of the sub-pixels 122*a* and the sub-pixels 122*b* according to the weighted coefficients WR1, the weighted coefficients WR2, and the data values of the corresponding color of the video signal VS. Thus, the operation efficiency of the driving device 140 is improved.

Figure 5:
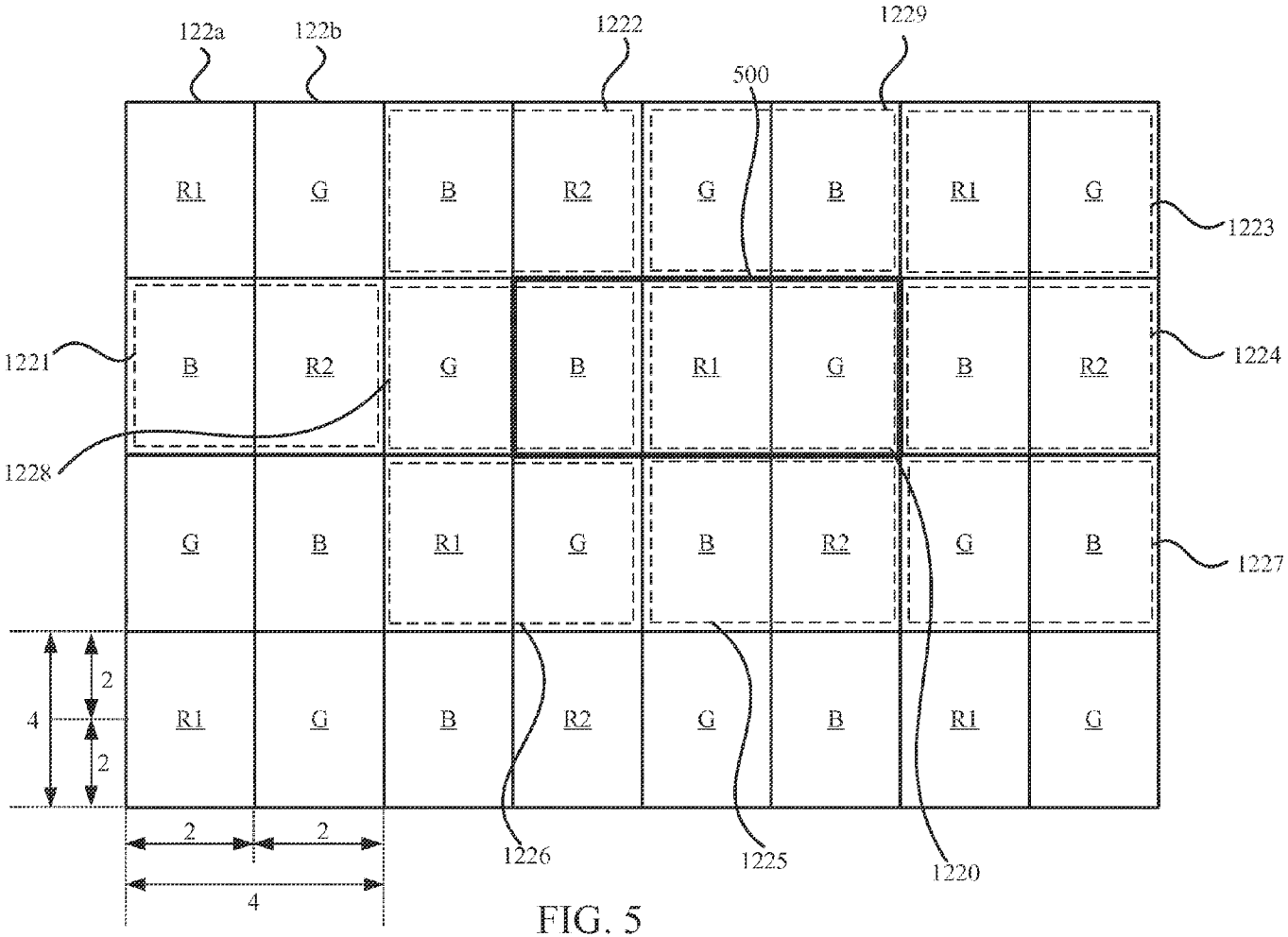
FIG. 5 is a schematic diagram illustrating operations of determining pixel values, in accordance with various embodiments of the present disclosure.

Reference is made to FIG. 5. FIG. 5 is a schematic diagram illustrating operations of determining pixel values, in accordance with various embodiments of the present disclosure.

Compared with FIG. 4, the driving device 140 is configured to determine the pixel value R1 of the sub-pixel 122*a* of the pixel 1220 according to a predetermined region 500, areas of the predetermine region 500 covered by the pixels 1228 and 1224, which are disposed at left side and at right side of the pixel 1220, and data values of red, corresponding to the pixels 1220, 1228 and 1224, of the video signal VS.

As shown in FIG. 5, the predetermined region 500 has a rectangular shape. Similarly, the predetermined region 500 is set based on the barycenter position of the sub-pixel 122*a* of the pixel 1220, the barycenter position of sub-pixel 122*b*, configured to display red, of the pixel 1221, and the barycenter position of the sub-pixel 122*b*, configured to display red, of the pixel 1224.

The driving device 140 is able to determine the pixel value R1 for the sub-pixel 122*a* of the pixel 1220 by calculating areas of the predetermined region 500 covered by the pixels 1220, 1228 and 1224. For illustration, the areas of the predetermined region 500 covered by the pixel 1228 is determined as follows: 4*2=8. The area of the predetermined region 500 covered by the pixel 1220 is determined as follows: 8+8=16. The area of the predetermined region 500 covered by the pixel 1224 is 0.

Thus, in this embodiment, the driving device 140 is configured to determine the pixel value R1 by calculating weighted coefficients WR1 related to the sub-pixel 122*a* of the pixel 1220 from the areas of the predetermined region 500 covered by the pixel 1220, the pixel 1228 at left side of the pixel 1220, and the pixel 1224 at right side of the pixel 1220. For illustration, after the areas of the predetermined region 500 covered by the pixels 1220, 1228 and 1224, the driving device 140 finds that the weighted coefficients WR1 related to the sub-pixel 122*a* of the pixel 1220 can be determined as an equation (3) below, in which 24 is the area of the predetermined region 500. Thus, the driving device 140 thus generates the pixel value R1 by using the weighted coefficients WR1 and the data values R, corresponding to the pixel 1220, 1228 and 1224, of the video signal VS.

$$WR3=[8\ 16\ 0]/24 \quad (3)$$

Similarly, the driving device 140 is able to determine the pixel value R2 of the sub-pixel 122*b* of the pixel 1222 with similar operations, and the repetitious descriptions are not given here. The driving device 140 finds that the weighted coefficients WR2 related to the sub-pixel 122*b* of the pixel 1222 can be determined as an equation (4) below, and the driving device 140 thus generates the pixel value R2 by using the weighted coefficients WR2 and the data values R, corresponding to the pixels at both sides of the pixel 1222, of the video signal VS.

$$WR4=[0\ 16\ 8]/24 \quad (4)$$

As the operations illustrated in FIG. 4 are considered of rendering sub-pixels in two dimensions, the operations illustrated in FIG. 5 are only considered of rendering sub-pixels in one dimension. Thus, the operation speed of the operations in FIG. 5 is faster than that of the operations in FIG. 4.

For illustrative purposes, the operations of determining pixel values in FIG. 4 and FIG. 5 are given with the arrangements in FIG. 3A. Various arrangements of the pixels 122, e.g., the arrangements in FIG. 3B, are able to be applied with the operation shown in FIG. 4 and FIG. 5, and those are considered to be within the contemplated scope of the present disclosure.

Figure 6:
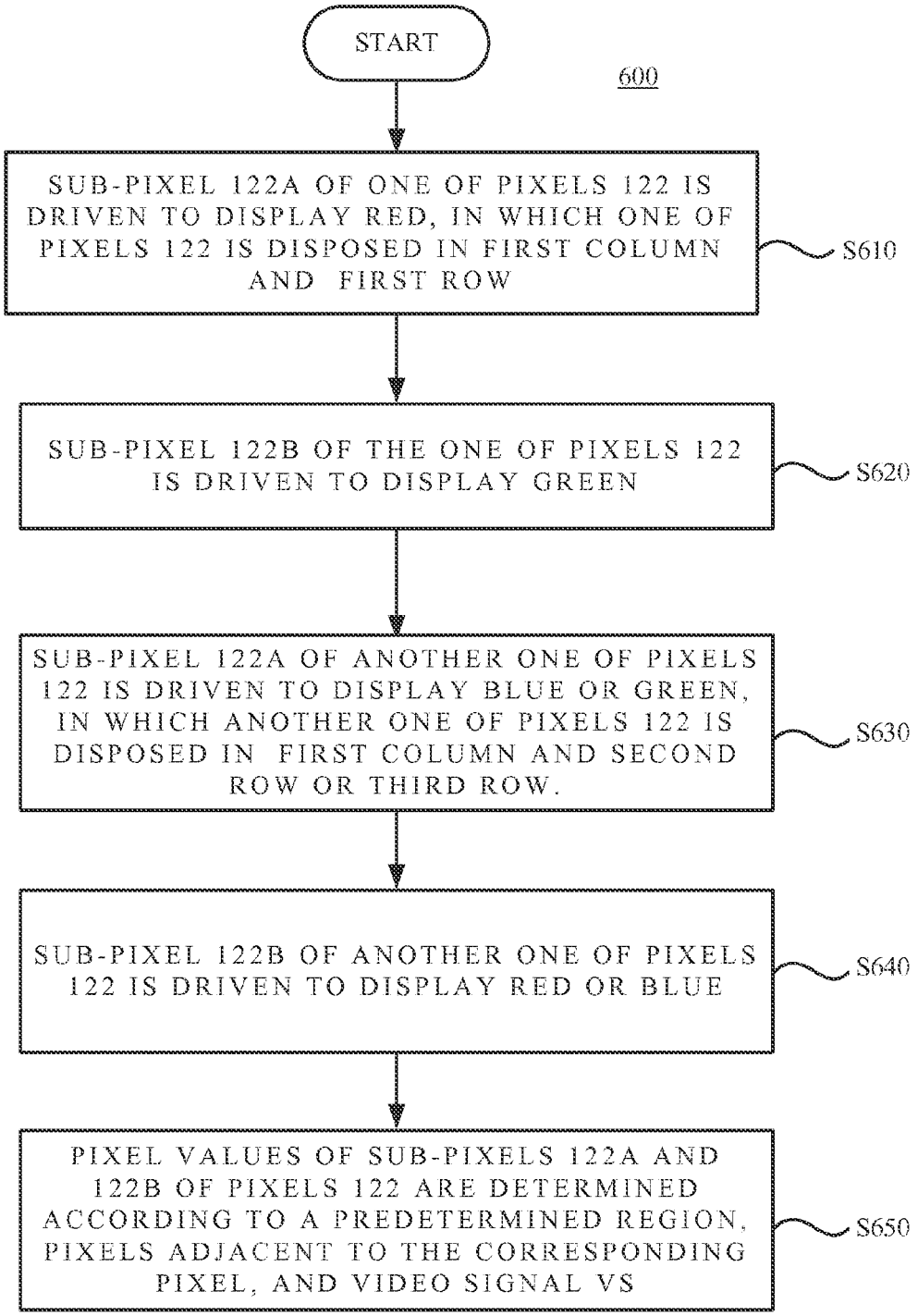
FIG. 6 is a flow chart of a method for driving a display device, in accordance with various embodiments of the present disclosure.

Reference is made to FIG. 6. FIG. 6 is a flow chart of a method for driving a display device, in accordance with various embodiments of the present disclosure. As shown in FIG. 6, the method 600 includes step S610, step S620, step S630, step S640, and step S650.

In step S610, the sub-pixel 122*a* of one of the pixels 122 is driven to display red, in which the one of the pixels 122 is disposed in the first column and the first row.

In step S620, the sub-pixel 122*b* of the one of the pixels 122 is driven to display green.

In step S630, the sub-pixel 122*a* of another one of the pixels 122 is driven to display blue or green, in which another one of the pixels 122 is disposed in the first column and the second row or the third row.

In step S640, the sub-pixel 122*b* of another one of the pixels 122 is driven to display red or blue.

For illustration, as shown in FIG. 3A, the sub-pixel 122*a* of the pixel 122 disposed in the first column and the second row is configured to display blue, and the sub-pixel 122*b* of the pixel 122 disposed in the first column and the second row is configured to display red. In this embodiment, the sub-pixel 122*a* of the pixel 122 disposed in the first column and the third row is configured to display green, and the sub-pixel 122*b* of the pixel 122 disposed in the first column and the third row is configured to display blue.

Alternatively, as shown in FIG. 3B, the sub-pixel 122*a* of the pixel 122 disposed in the first column and the second row is configured to display green, and the sub-pixel 122*b* of the pixel 122 disposed in the first column and the second row is configured to display blue. In this embodiment, the sub-pixel 122*a* of the pixel 122 disposed in the first column and the third row is configured to display blue, and the sub-pixel 122*b* of the pixel 122 disposed in the first column and the third row is configured to display red.

In step S650, pixel values of the sub-pixels 122*a* and 122*b* of the pixels 122 are determined according to a predetermined region, the pixels adjacent to the corresponding pixel, and the video signal VS.

For illustration, the pixel values of the sub-pixel 122*a* and 122*b* are able to be determined by the operations illustrated in FIG. 4. Alternatively, the pixel values of the sub-pixel 122*a* and 122*b* are also able to be determined by the operations illustrated in FIG. 5. The operations of FIG. 4 and FIG. 5 are described above, and thus the repetitious descriptions are not given here.

In some embodiments, the driving device 140 is implemented in the video source, such as a video card, and thus bandwidth of transmission in the display system 100 is further improved. In some other embodiments, the driving device 140 is able to be implemented in a timing controller of a panel driver.

In various embodiments, the driving device 140 is a design tool carried on a non-transitory computer-readable medium storing the method 600. In other words, the driving device 140 is implemented in hardware, software, firmware, and the combination thereof. For illustration, if speed and accuracy are determined to be paramount, a mainly hardware and/or firmware vehicle is selected and utilized. Alternatively, if flexibility is paramount, a mainly software implementation is selected and utilized.

In summary, the display system and the method for driving a display device of the present disclosure are able to improve the aperture ratio of the display panel and remain the display quality as well. Thus, manufacture difficulty and manufacture cost of the display panel are also reduced.

It will be apparent to those skilled in the art that various modifications and variations can be made to the structure of the present disclosure without departing from the scope or spirit of the invention. In view of the foregoing, it is intended that the present invention cover modifications and variations of this invention provided they fall within the scope of the following claims.

What is claimed is:

1. A display system, comprising:

a plurality of pixels arranged in rows and columns, each of the pixels comprising a first sub-pixel and a second sub-pixel arranged along a horizontal direction, the pixels comprising:

a first pixel disposed in a first column of pixels and in a first row of pixels, wherein the first sub-pixel of the first pixel is configured to display a first color, and the second sub-pixel of the first pixel is configured to display a second color; and a second pixel disposed in the first column of pixels and in one of a second row of pixels and a third row of pixels, wherein the first sub-pixel of the second pixel is configured to display a third color, and the second sub-pixel of the second pixel is configured to display the first color;

a driving device configured to determine a pixel value of the first sub-pixel of the first pixel according to areas of a predetermined region covered by the first pixel and pixels around the first pixel, and data values of the first color, corresponding to the first pixel and the pixels around the first pixel, of a video signal;

wherein the predetermined region has a shape of a parallelogram, and the parallelogram is set based on distances between barycenter positions of the first sub-pixel and one of the first sub-pixel and the second sub-pixel, configured to display the first color, of the pixels around the first pixel, respectively.

2. The display system of claim 1, wherein when the second pixel is disposed in the second row of pixels, the pixels further comprises:

a third pixel disposed in the first column of pixels and in the third row of pixels, wherein the first sub-pixel of the third pixel is configured to display the second color, and the second sub-pixel of the third pixel is configured to display the third color.

3. The display system of claim 1, wherein when the second pixel is disposed in the third row of pixels, the pixels further comprises:

a third pixel disposed in the first column of pixels and in the second row of pixels, wherein the first sub-pixel of the third pixel is configured to display the second color, and the second sub-pixel of the third pixel is configured to display the third color.

4. The display system of claim 1, wherein each one of the first sub-pixel and the second sub-pixel has an aspect ratio of about: 1:2.

5. The display system of claim 4, wherein the driving device is configured to calculate a plurality of weighted coefficients according to areas of the predetermined region covered by the first pixel and the pixels adjacent to the first pixel.

6. The display system of claim 5, wherein the pixel value of the first sub-pixel of the first pixel is determined according to the weighted coefficients and data values of the first color, corresponding to the first pixel and the pixels adjacent to the first pixel, of the video signal.

7. A method for driving a display device, the display device comprising a plurality of pixels arranged in rows and columns, each of the pixels comprising a first sub-pixel and a second sub-pixel arranged in a horizontal direction, the method comprising:

driving the first sub-pixel of a first pixel of the pixels to display a first color, wherein the first pixel is disposed in a first column of pixels and in a first row of pixels;

driving the second sub-pixel of the first pixel to display a second color;

driving the first sub-pixel of a second pixel to display a third color, wherein the second pixel is disposed in the first column of pixels and in a second row of pixels or a third row of pixels;

driving the second sub-pixel of the second pixel to display the first color; and determining a pixel value of the first sub-pixel of the first pixel according to areas of a predetermined region covered by the first pixel and pixels around the first pixel, and data values of the first color, corresponding to the first pixel and the pixels around the first pixel, of a video signal;

wherein the predetermined region has a shape of a parallelogram, and the parallelogram is set based on distances between barycenter positions of the first sub-pixel and one of the first sub-pixel and the second sub-pixel, configured to display the first color, of the pixels around the first pixel, respectively.

8. The method of claim 7, wherein when the second pixel is disposed in the second row of pixels, the method further comprises:

driving the first sub-pixel of a third pixel to display the second color, wherein the third pixel disposed in the first column of pixels and in the third row of pixels; and driving the second sub-pixel of the third pixel to display the third color.

9. The method of claim 7, wherein when the second pixel is disposed in the third row of pixels, the method further comprises:

driving the first sub-pixel of the third pixel to display the second color, wherein third pixel disposed in the first column of pixels and in the second row of pixels; and driving the second sub-pixel of the third pixel to display the third color.

10. The method of claim 7, wherein each one of the first sub-pixel and the second sub-pixel has an aspect ratio of about 1:2, the step of determining the pixel value comprises:

calculating a plurality of weighted coefficients according to areas of the predetermined region covered by the first pixel and the pixels adjacent to the first pixel.

11. The method of claim 10, wherein the step of determining the pixel value comprises:

determining the pixel value of the first sub-pixel of the first pixel according to the weighted coefficients and data values of the first color, corresponding to the first pixel and the pixels adjacent to the first pixel, of the video signal.

12. A non-transitory computer readable storage medium for storing instructions that when executed by a driving device, cause the driving device to perform a driving method, wherein the display device comprises a plurality of pixels arranged in rows and columns, each of the pixels comprises a first sub-pixel and a second sub-pixel arranged in a horizontal direction, and the driving method comprises:

driving the first sub-pixel of a first pixel of the pixels to display a first color, wherein the first pixel is disposed in a first column of pixels and in a first row of pixels;

driving the second sub-pixel of the first pixel to display a second color;

driving the first sub-pixel of a second pixel to display a third color, wherein the second pixel is disposed in the first column of pixels and in a second row of pixels or a third row of pixels;

driving the second sub-pixel of the second pixel to display the first color; and determining a pixel value of the first sub-pixel of the first pixel according to areas of a predetermined region covered by the first pixel and pixels around the first pixel, and data values of the first color, corresponding to the first pixel and the pixels around the first pixel, of a video signal;

wherein the predetermined region has a shape of a parallelogram, and the parallelogram is set based on distances between barycenter positions of the first sub-pixel and one of the first sub-pixel and the second sub-pixel, configured to display the first color, of the pixels around the first pixel, respectively.

* * * * *